US005660299A

United States Patent [19]

Harvey

[11] Patent Number: 5,660,299

[45] Date of Patent: Aug. 26, 1997

[54] COMPARTMENTED COOLER

[76] Inventor: Allen W. Harvey, 3265 Antalope Rd. #33, White City, Oreg. 97503

[21] Appl. No.: 618,124

[22] Filed: Mar. 19, 1996

[51] Int. Cl.[6] ..... B65D 21/02

[52] U.S. Cl. ..... 220/524; 220/254; 220/909

[58] Field of Search ..... 220/909, 924, 220/254

[56] References Cited

U.S. PATENT DOCUMENTS

| | | | |
|---|---|---|---|
| Re. 7,150 | 5/1876 | Sherer | 220/524 |
| 161,829 | 4/1875 | Sherer | 220/524 |
| 360,991 | 4/1887 | Brandt | 220/524 |
| 1,470,199 | 10/1923 | Small | 220/524 |
| 2,747,388 | 5/1956 | Dolar | 220/524 |
| 4,905,853 | 3/1990 | Strawder | 220/909 |
| 5,015,143 | 5/1991 | Carson | 220/909 |
| 5,392,916 | 2/1995 | Paulison | 220/909 |

*Primary Examiner*—Joseph M. Moy

[57] ABSTRACT

A two-n-one cooler including an insulated container having a bottom wall with a rear wall, a front wall, a pair of side walls and an interior wall extending upward therefrom. The front wall has a pair of front upper edges and the rear wall has a pair of rear upper edges with a passage through each rear upper edge. The pair of side walls each have a short upper edge extending from the rear wall in a horizontal plane for a portion thereof and a remaining portion sloping downward toward the front wall. The interior wall is integral with the front and rear walls and spaced from one of the pair of side walls to form two chambers within the container. The interior wall has a projecting upper edge with an aperture therethrough and adjacent each rear upper edge. A first lid has an upper surface and a lower surface with an opening therethrough and positionable over one chamber. The opening has a door positioned therein. A second lid is positionable over another chamber of the container.

1 Claim, 3 Drawing Sheets

84
128
92
88
10
106
148
152
112
170
94
174
130
154
114
156
86
14
96
95
162
62
24
159
16
12

170
148
168
128
6
102
100
122
124
136
112
150
98
130
116
124
62
114
144
158
22
136
6

FIG 5
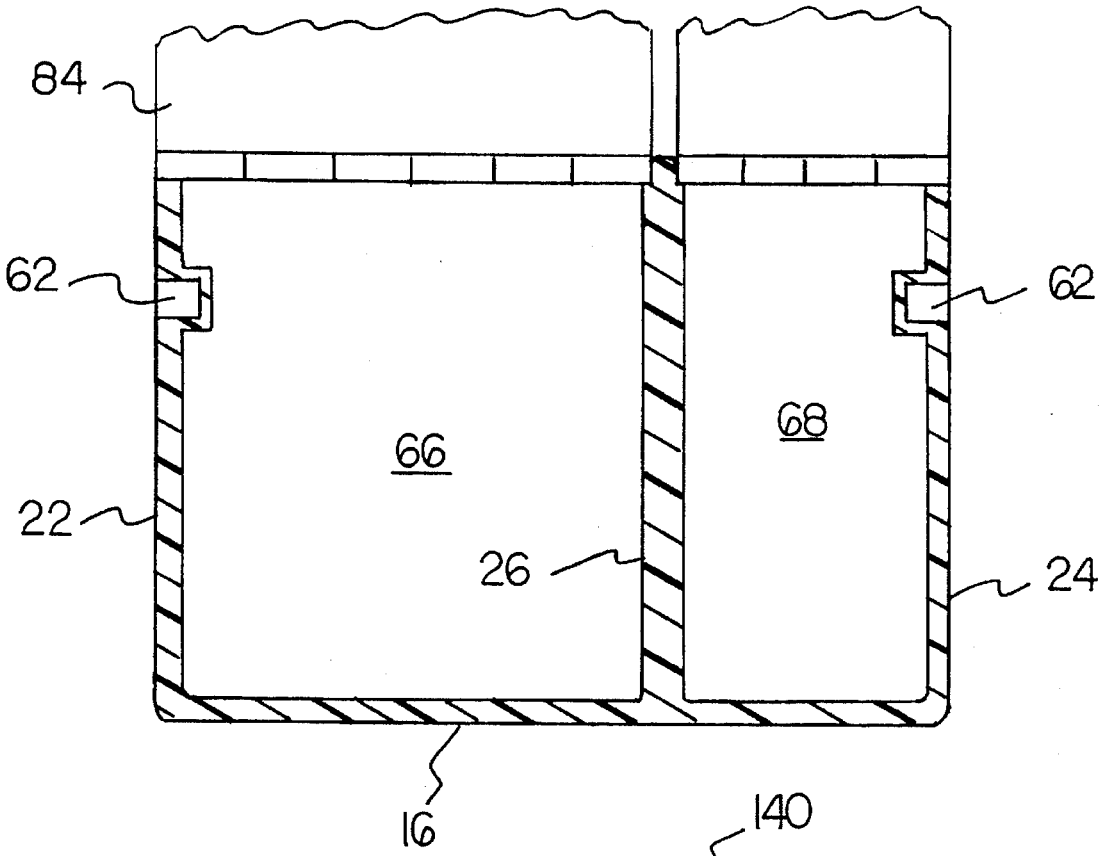
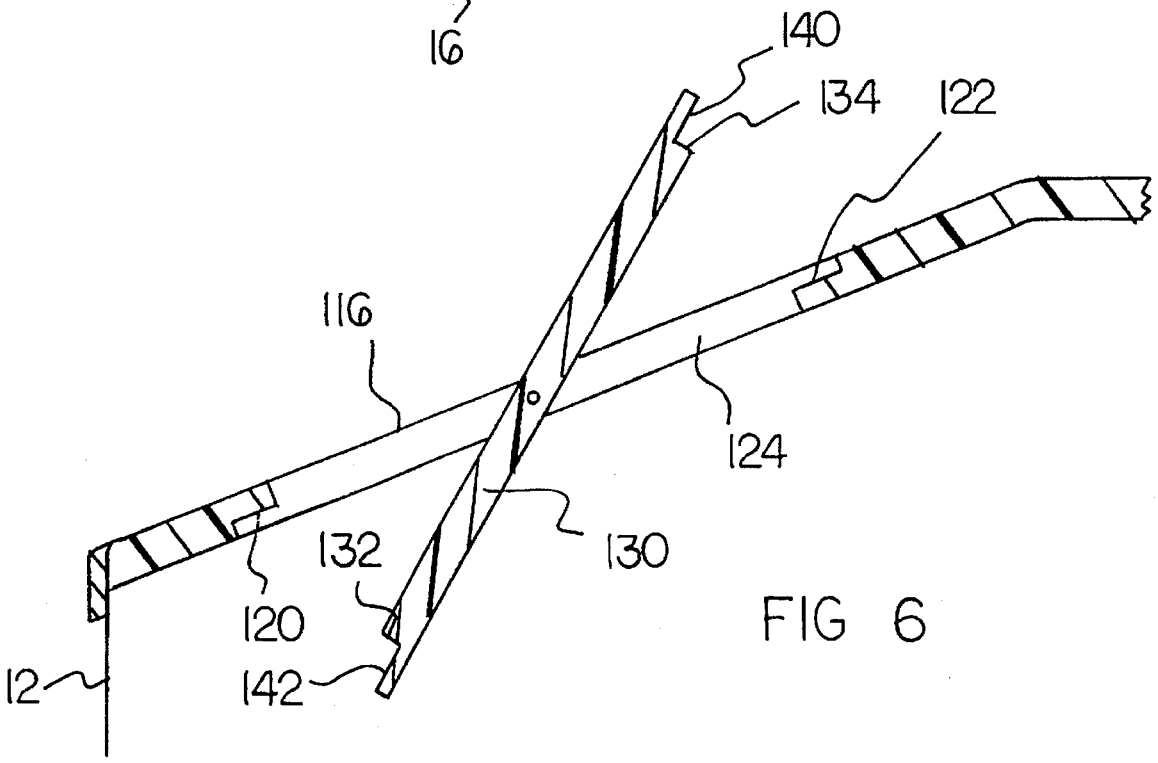
FIG 6

COMPARTMENTED COOLER

BACKGROUND OF THE INVENTION

1. Field of the Invention

The present invention relates to a two-n-one cooler and more particularly pertains to providing a cooler that has two sides with one side for storing fish and the other side for storing refreshments and further providing separate lids for each side of the cooler when the cooler is transported by a fisherman on a fishing outing.

2. Description of the Prior Art

The use of coolers is known in the prior art. More specifically, coolers heretofore devised and utilized for the purpose of storing food are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,329,787 to Friday discloses a combination food and beverage cooler. U.S. Pat. No. 5,305,544 to Testa discloses a bait storage cooler and tackle holder arrangement. U.S. Pat. No. 5,277,328 to Tocco discloses a multiply compartmented cooler. U.S. Pat. No. 5,129,552 to Painchaud and Sinapi discloses a multipurpose keg tapper. U.S. Pat. No. 5,048,639 to Scherer discloses a portable cooler assembly. Lastly, U.S. Pat. No. Des. 290,080 to Carlson discloses a combination cooler box, bottle and tray.

While these devices fulfill their respective, particular objectives and requirements, the aforementioned patents do not describe two-n-one cooler that allows a fisherman to place freshly caught fish in one side of the cooler without contaminating the refreshments in the other side of the cooler when the cooler is in use.

In this respect, the two-n-one cooler according to the present invention substantially departs from the conventional concepts and designs of the prior art, and in doing so provides an apparatus primarily developed for the purpose of providing a cooler that has two sides with one side for storing fish and the other side for storing refreshments and further providing separate lids for each side of the cooler when the cooler is transported by a fisherman on a fishing outing.

Therefore, it can be appreciated that there exists a continuing need for a new and improved two-n-one cooler which can be used for storing fish in one side of the cooler while the other side is used for storing refreshments and further providing separate lids for each side of the cooler when the cooler is transported by a fisherman on a fishing outing. In this regard, the present invention substantially fulfills this need.

SUMMARY OF THE INVENTION

In view of the foregoing disadvantages inherent in the known types of coolers now present in the prior art, the present invention provides an improved two-n-one cooler. As such, the general purpose of the present invention, which will be described subsequently in greater detail, is to provide a new and improved two-n-one cooler and method which has all the advantages of the prior art and none of the disadvantages.

To attain this, the present invention essentially comprises an insulated container. The container has a rectangular bottom wall with a rectangular rear wall, a rectangular front wall and a pair of pentagonal side walls extending upwardly therefrom. The bottom wall further has a pentagonal interior wall extending upward therefrom and perpendicular the front and rear walls. The interior wall has a projecting upper edge. The front has a first front upper edge and a second front upper edge. The rear wall has a first rear upper edge and a second rear upper edge. The upper edges of the front and rear wall are separated by the projecting upper edge of the interior wall. Each rear upper edge extending beyond the side walls. The first rear upper edge has a first passage therethrough and the second rear upper edge has a second passage therethrough. Each passage runs along an axis parallel the rear wall. The pair of side walls, forming a first side wall and a second side wall, are integral with and perpendicular the rear and front walls. Each side wall has a short upper edge. Each short upper edge extends from the rear wall in a horizontal plan for a portion thereof and sloping downward toward the front wall a remaining portion thereof. Each side wall has a pair of cavities spaced apart and spaced from the short upper edge. The interior wall is integral with the front and rear walls. The interior wall, is spaced from the second side wall, forms two chambers within the container. One chamber is large and the other chamber is small. The projecting upper edge of the interior wall extends from the rear wall in a horizontal plan for a short length and sloping downward toward the front wall for a remaining length thereof. The interior wall has an aperture extending therethrough. The aperture is adjacent the projecting upper edge and aligned with each passage of each upper edge of the rear wall. A first lid formed of insulated material is included. The first lid has a first front edge, a first rear edge and a pair of opposed side edges extending therebetween. The first front edge has an overhang portion extending downward therefrom. The pair of side edges form an interior edge and an exterior edge with the exterior edge having a overhang portion extending downward therefrom. The overhang portion of the exterior edge is integral the overhang of the first front edge. The exterior edge has a generally rectangular projection with a slot therethrough extending adjacent the first rear edge. The rear edge has a projection with a slot therethrough extending downward therefrom and adjacent the interior edge. The first lid further has an upper surface and a lower surface and a generally rectangular opening therethrough. The upper surface has graduated markings integral thereto and next to the first rear edge for measuring a fish. The first lid is positionable over the large chamber of the container with each slot capable of aligning with the passage of the first upper edge of the rear wall and the aperture of the interior wall. A generally rectangular door is included. The door has a front end, a rear end and a pair of side ends with an aperture therethrough. The door formed for positioning within the opening of the first lid. The door has a rotation rod positioned through the aperture of the door for allowing movement of the door within the opening of the first lid. A second lid formed of insulated material is provided. The second lid has a second front edge, a second rear edge and a pair of opposed side edges extending therebetween. The second front edge has an overhang portion extending downward therefrom. The pair of side edges form an interior edge and an exterior edge with the exterior edge having a overhang portion extending downward therefrom. The overhang portion of the exterior edge of the second lid is integral the overhang of the second front edge. The exterior edge has a generally rectangular projection with a slot therethrough extending adjacent the second rear edge. The rear edge has a projection with a slot therethrough extending downward therefrom and adjacent the interior edge. The second lid has an upper surface with graduated markings sequential with the graduated markings of the first lid and next to the second rear edge for measuring a fish. The second lid is positionable over the small chamber of the container with each slot aligning with the passage of the second upper edge of the rear wall and the aperture of the interior wall. Lastly, a cylindrical rod is provided. The rod has a length for positioning through the slots of the lid, the aperture of the projecting upper edge of the interior wall and the passage of the first and second upper edge of the rear wall. The rod is capable of securing the first lid and the second lid to the rear wall of the container in a movable manner for opening. The rod is capable of securing the first lid and the second lid to the container. When the first and second lid are secured to the container the front edge, the exterior edge and the interior edge of the first and second lid rest upon the respective front edge and short edge of the container for closure.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved two-n-one cooler which has all of the advantages of the prior art coolers and none of the disadvantages.

It is another object of the present invention to provide a new and improved two-n-one cooler which may be easily and efficiently manufactured and marketed.

It is further object of the present invention to provide a new and improved two-n-one cooler which is of durable and reliable constructions.

An even further object of the present invention is to provide a new and improved two-n-one cooler which is susceptible of a low cost of manufacture with regard to both materials and labor, and which accordingly is then susceptible of low prices of sale to the consuming public, thereby making such two-n-one cooler economically available to the buying public.

Still yet another object of the present invention is to provide a new and improved two-n-one cooler which provides in the apparatuses and methods of the prior art some of the advantages thereof, while simultaneously overcoming some of the disadvantages normally associated therewith.

Even still another object of the present invention is to provide a two-n-one cooler that has two sides with one side for storing fish and the other side for storing refreshments and further providing separate lids for each side of the cooler when the cooler is transported by a fisherman on a fishing outing.

Lastly, it is an object of the present invention to provide a new and improved two-n-one cooler comprising an insulated container. The container has a bottom wall with a rear wall, a front wall, a pair of side walls and an interior wall extending upward therefrom. The front wall has a pair of front upper edges and the rear wall has a pair of rear upper edges with a passage through each rear upper edge. The pair of side walls each have a short upper edge extending from the rear wall in a horizontal plane for a portion thereof and a remaining portion sloping downward toward the front wall. The interior wall is integral the front and rear walls and spaced from one of the pair of side walls to form two chambers within the container. The interior wall has a projecting upper edge with an aperture therethrough and adjacent each rear upper edge. A first lid has a first rear edge and an upper surface and a lower surface with an opening therethrough. The first lid is capable of being secured over one chamber of the container. The first lid further has a door for positioning over the opening. Lastly, a second lid has an upper surface, a second front edge, a second rear edge and a pair of opposed side edges extending therebetween. The second lid is capable of being secured over another chamber of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a sectional view of the two-n-one cooler along lines 4—4 of FIG. 3.

FIG. 6 is a sectional view of a lid of the two-n-one cooler along lines 6—6 of FIG. 2.

The same reference numerals refer to the same parts through the various Figures.

DESCRIPTION OF THE PREFERRED EMBODIMENT

Figure 1:
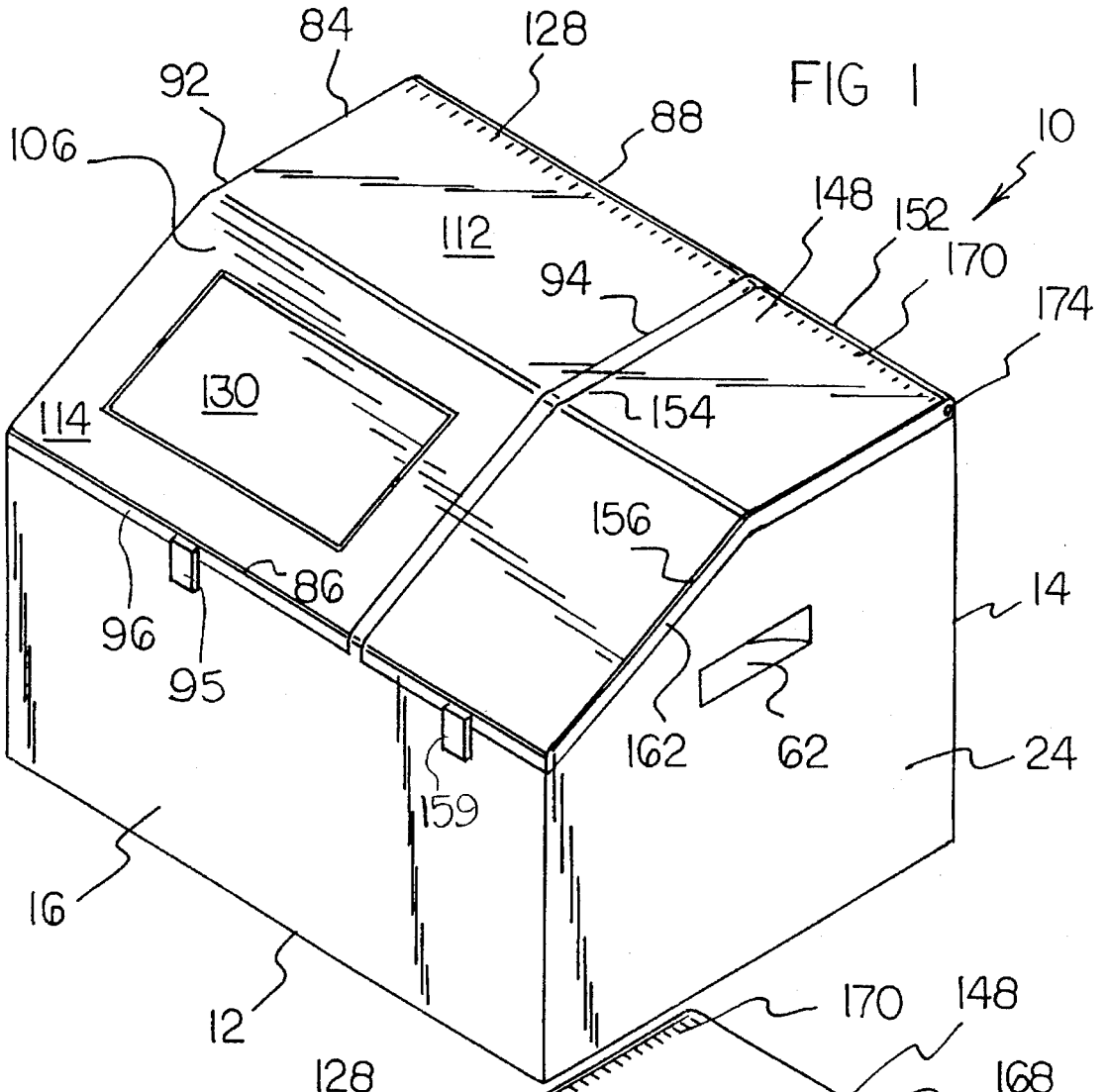
FIG. 1 is a perspective view of the preferred embodiment of the two-n-one cooler constructed in accordance with the principles of the present invention.

With reference now to the drawings, and in particular to FIG. 1 thereof, the preferred embodiment of the new and improved two-n-one cooler embodying the principles and concepts of the present invention and generally designated by the reference numeral 10 will be described.

The present invention, the two-n-one cooler 10 is comprised of a plurality of components. Such components in their broadest context include a container, two lids, and a door. Such components are individually configured and correlated with respect to each other so as to attain the desired objective.

Figure 3:
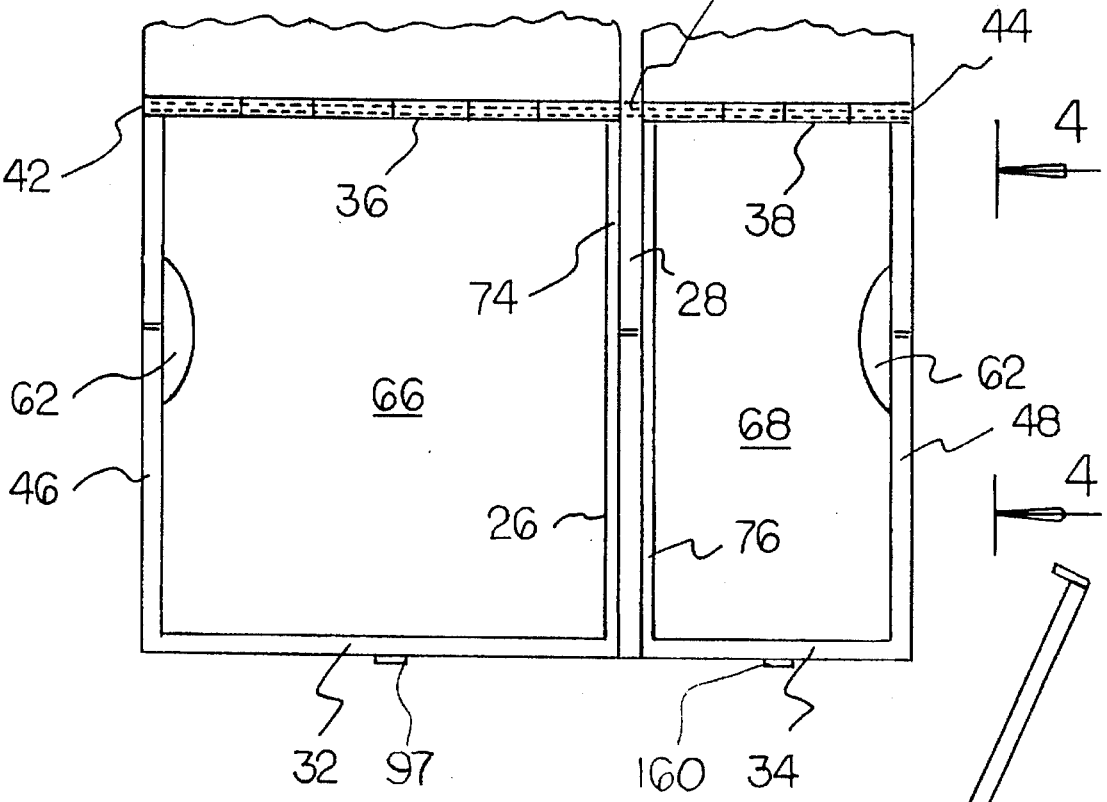
FIG. 3 is top plan view of the two-n-one cooler with the lid removed.
Figure 4:
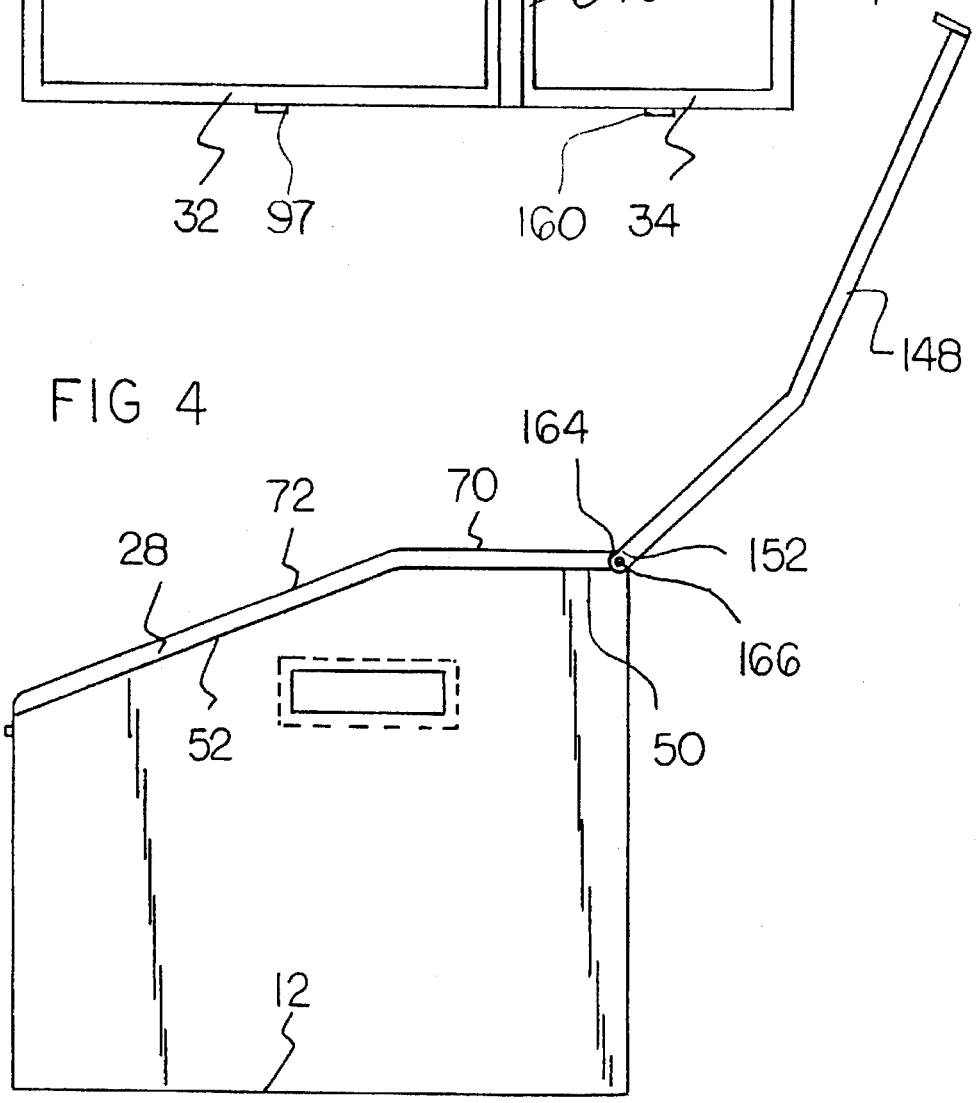
FIG. 4 is a side View of the two-n-one cooler in an operable configuration.

Specifically, the present invention includes an insulated container 10 a shown in FIG. 1. The container is made of a rigid high density plastic. The container has a rectangular bottom wall 12 with a rectangular rear wall 14, a rectangular front wall 16 and a pair of pentagonal side walls, 22 and 24, extending upwardly therefrom. The bottom wall further has a pentagonal interior wall 26 extending upward therefrom and perpendicular the front and rear walls. The interior wall has a projecting upper edge 28 as shown in FIG. 4. As illustrated in FIG. 3, the front wall has a first front upper edge 32 and a second front upper edge 34. The rear wall has a first rear upper edge 36 and a second rear upper edge 38 as depicted in FIG. 3. The upper edges of the front and rear wall being separated by the projecting upper edge of the interior wall. Each rear upper edge has a height that allows it to extending above the side walls. The first rear upper edge has a first passage 42 therethrough and the second rear upper edge has a second passage 44 therethrough with each passage running along an axis parallel the rear wall.

Figure 2:
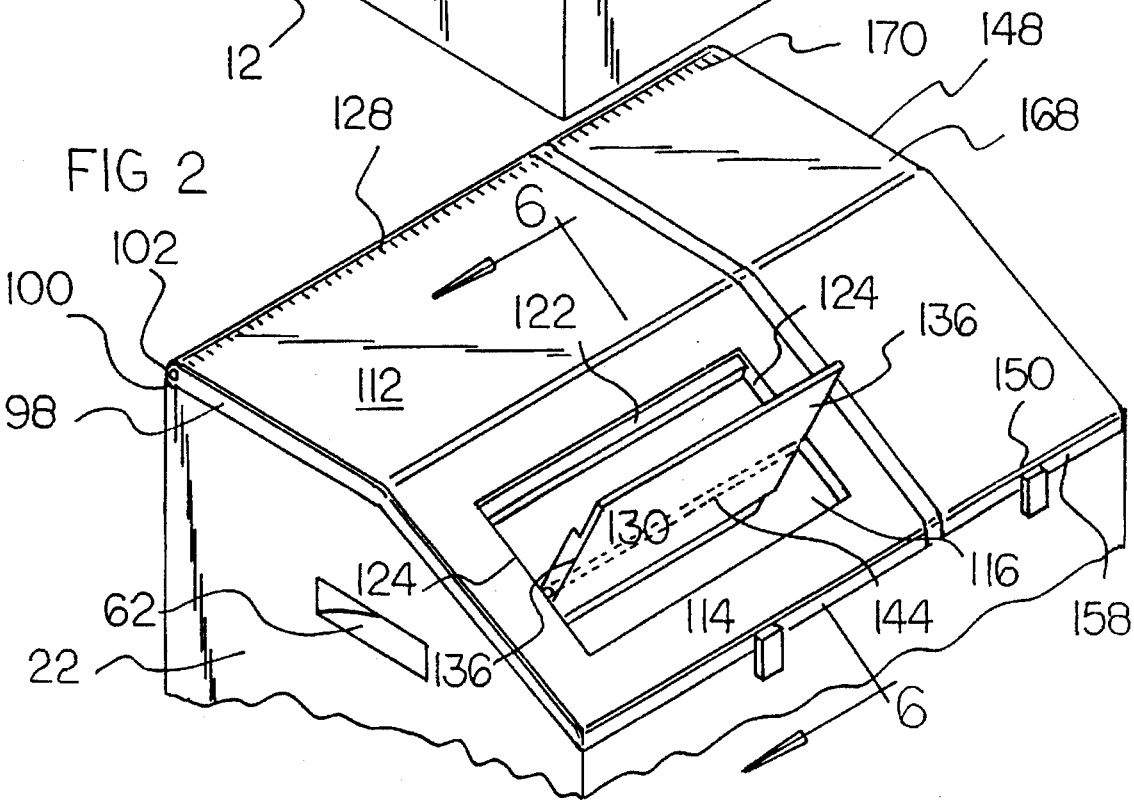
FIG. 2 is side cut-away view of the two-n-one cooler in an operable configuration.

The pair of side wall, as shown in FIGS. 1 and 2, form a first side wall 22 and a second side wall 24, The first and second side walls are integral with and perpendicular the rear and front walls. Each side wall has a short upper edge 46 and 48. As illustrated in FIG. 4, each short upper edge extends from the rear wall in a horizontal plan for a portion 50 thereof and slops downward toward the front wall a remaining portion 52 thereof. Each side wall has a lower cavity 62 spaced from the short upper edge.

Each lower cavity is centrally located on each side wall. Additionally, as shown in FIG. 3 each lower cavity projects into the container 10. Each cavity is used as a handle for carrying the two-n-one cooler. The user can place a portion of their had into the lower cavity on either side of the container.

The interior wall 26 of the container is integral with the front 16 and rear walls 14 as shown in FIG. 4 and 5. The interior wall is spaced from the second side wall 24 to form two chambers 66 and 68 within the container with one chamber large 66 and the other chamber small 68. Each chamber has a generally rectangular shape. The projecting upper edge 28 of the interior wall extends from the rear wall in a horizontal plan for a short length 70 and sloping downward toward the front wall for a remaining 72 length thereof.

The projecting upper edge 28 has a height that extends slightly above the height of the side wall and equal to the height of each upper rear edge of the rear wall. A first shelf 74 and second shelf 76 are formed at the base of the projecting upper edge as shown in FIG. 4. The first shelf is integral with the first front upper edge 32 and the second shelf is integral with the second front upper edge 34. The interior wall has an aperture 80 extending therethrough. The aperture is adjacent the projecting upper edge and aligned with each passage of each upper edge of the rear wall.

A first lid 84 as shown in FIG. 1 is provided. The first lid is formed of insulated material and plastic. The first lid has a first front edge 86, a first rear edge 88 and a pair of opposed side edges, 92 and 94, extending therebetween. The first front edge has an overhang portion 96 extending downward therefrom and beyond the first front upper edge 32. The overhang has a first latch member 95 projecting downward and interconnected. The first latch member snap fastens with a first coupler 97, as seen in FIG. 3, that is spaced from the first front upper edge 32 of chamber 66. The first latch secures the first lid to the front wall 16 of the present invention.

The pair of side edges of the first lid form an interior edge 94 and an exterior edge 92 with the exterior edge having a overhang portion 98 extending downward therefrom. The overhang of the exterior edge extends beyond the short upper edge of the first side wall and is integral the overhang of the first front edge. The exterior edge has a generally rectangular projection 100 with a slot 102 therethrough extending adjacent the first rear edge. The first rear edge has a projection with a slot therethrough extending downward therefrom and adjacent the interior edge.

The first lid further has an upper surface 106, a lower surface 108, a back portion 112 and a front portion 114 with a generally rectangular opening 116 therethrough. The opening is generally rectangular in shape. The opening has a front lower ledge 120, a rear upper ledge 122 and a pair of side edges 124 therebetween as shown in FIG. 6. The upper surface has graduated markings 128 integral thereto and next to the first rear edge for measuring a fish. The first lid is positionable over the large chamber 66 of the container with each slot aligning with the passage 42 of the first upper edge of the rear wall and the aperture 80 of the interior wall.

Also included is a generally rectangular door 130. The door has a front end 132, a rear end 134 and a pair of side ends 136 with an aperture therethrough. The door is made of a high density plastic. The rear end of the door has an interior flap 140 projecting therefrom. The front end of the door has an exterior flap 142 projecting therefrom. The flaps of the door interact with the respective ledge 120 and 122 of the opening. The door is sized to be positioned within the opening of the first lid 84. The door has a rotation rod 144 positioned through the aperture of the door for allowing movement of the door within the opening 116 of the first lid. The interaction of the flaps and ledge keep the door from turning in a complete circular motion within the opening. Additionally the door allows fish to be placed in the large chamber without lifting of the first lid.

As illustrated in FIG. 1, a second lid 148 is included. The second lid is formed of insulated material and plastic. The second lid has a second front edge 150, a second rear edge 152 and a pair of opposed side edges 154 and 156 extending therebetween. The second front edge has an overhang portion 158 extending downward therefrom beyond the second front upper edge 34. The overhang has a second latch member 159 projecting downward and interconnected. The second latch member snap fastens with a second coupler 160 that is spaced from the second front upper edge 34 of chamber 68. The second latch secures the second lid to the front wall 16 of the present invention.

The pair of side edges of the second lid form an interior edge 154 and an exterior edge 156 with the exterior edge having a overhang portion 162 extending downward therefrom. The overhang portion of the exterior edge of the second lid extend beyond the short upper edge 48 of the second side wall 24. The overhang portion of the exterior edge of the second lid is integral the overhang of the second front edge.

The exterior edge has a generally rectangular projection 164 with a slot 166 therethrough extending adjacent the second rear edge. The second rear edge has a projection with a slot therethrough extending downward therefrom and adjacent the interior edge. The second lid has an upper surface 168 with graduated markings 170 sequential with the graduated markings 128 of the first lid 84 and next to the second rear edge for measuring a fish. The second lid is positionable over the small chamber 68 of the container with each slot aligning with the passage 44 of the second upper edge of the rear wall and the aperture 80 of the interior wall.

Lastly, a cylindrical rod 174 is provided. The rod has a length and diameter for positioning through the slots of the lid, the aperture 80 of the projecting upper edge of the interior wall and the passages, 42 and 44, of the first and second upper edge of the rear wall. The rod allows the first lid and the second lid to be secured to the rear wall 14 of the container in a movable manner for opening. The rod is capable of securing the first lid and the second lid to the container whereby the front edge, the exterior edge and the interior edge of the first and second lid rest upon the respective front edge and short edge of the container in a closed position. The interior edge of the of the first and second lid rest flush with the respective shelf of the interior wall.

The present invention is a two-n-one cooler that has two separate chambers and two separate lids to cover each chamber which allow separate use of each chamber. The cooler is made of plastic with insulation material contained within its wall. The interior wall that separates the two chambers is integral with the bottom wall and the front and rear wall. The interior wall being formed in this manner prevents moisture or aroma from one chamber contaminating the other chamber. The two-n-one cooler, as formed, gives a fisherman one cooler that can serve all needs when on a fishing outing. The need for two coolers is eliminated. Freshly caught fish can be placed in the larger chamber through the door on the first lid of the chamber. This allows the first lid to only release small amounts of cool air.

The lid of each chamber has graduated markings on top. This allows the fisherman to measure his/her catch prior to placing it in the first chamber. Each side wall of the cooler has a handle preformed therein. The handle will fit various hand sizes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A new and improved compartmented cooler system for storage of a fisherman's catch and refreshments comprising, in combination:

an insulated container having a rectangular bottom wall with a rectangular rear wall, a rectangular front wall and a pair of pentagonal side walls extending upwardly therefrom, the bottom wall further having a pentagonal interior wall extending upward therefrom and perpendicular the front and rear walls, the interior wall having a projecting upper edge, the front wall having a first front upper edge and a second front upper edge, the rear wall having a first rear upper edge and a second rear upper edge, the upper edges of the front and rear wall being separated by the projecting upper edge of the interior wall, each rear upper edge having a height for extending above the side walls, the first rear upper edge having a first passage therethrough and the second rear upper edge having a second passage therethrough with each passage running along an axis parallel the rear wall;

the pair of side walls forming a first side wall and a second side wall integral with and perpendicular the rear and front walls, each side wall having a short upper edge, each short upper edge extending from the rear wall in a horizontal plan for a portion thereof and sloping downward toward the front wall a remaining portion thereof, each side wall having a lower cavity spaced from the short upper edge;

each lower cavity being centrally located on each side wall and projects into the container, each lower cavity being used as a handle for carrying;

the interior wall being integral with the front and rear walls, the interior wall further being spaced from the second side wall forming two generally rectangular chambers within the container with one chamber being large and the other chamber being small, the projecting upper edge of the interior wall extending from the rear wall in a horizontal plan for a short length and sloping downward toward the front wall for a remaining length thereof;

the projecting upper edge having a height for extending slightly above the height of the side wall and equal to the height of each upper rear edge of the rear wall, a first shelf and a second shelf being formed at the base of the projecting upper edge, the first shelf being integral with the first front upper edge and the second shelf being integral the second front upper edge, the interior wall having an aperture extending therethrough and adjacent the projecting upper edge and aligned with each passage of each upper edge of the rear wall;

a first lid formed of insulated material having a first front edge, a first rear edge and a pair of opposed side edges extending therebetween, the first front edge having an overhang portion extending downward therefrom, the pair of side edges of the first lid form an interior edge and an exterior edge with the exterior edge having a overhang portion extending downward therefrom and integral the overhang of the first front edge, the exterior edge having a generally rectangular projection with a slot therethrough extending adjacent the first rear edge, the rear edge having a projection with a slot therethrough extending downward therefrom and adjacent the interior edge, the first lid further having an upper surface and a lower surface and a generally rectangular opening therethrough, the upper surface having graduated markings integral thereto and next to the first rear edge for measuring a fish, the first lid being positionable over the large chamber of the container with each slot capable of aligning with the passage of the first upper edge of the rear wall and the aperture of the interior wall;

a generally rectangular door having a front end, a rear end and a pair of side ends with an aperture therethrough, the door formed for positioning within the opening of the first lid, the door having a rotation rod positioned through the aperture of the door for allowing movement of the door within the opening of the first lid;

a second lid formed of insulated material having a second front edge, a second rear edge and a pair of opposed side edges extending therebetween, the second front edge having an overhang portion extending downward therefrom, the pair of side edges of the second lid form an interior edge and an exterior edge with the exterior edge having a overhang portion extending downward therefrom and integral the overhang of the second front edge, the exterior edge having a generally rectangular projection with a slot therethrough extending adjacent the second rear edge, the rear edge having a projection with a slot therethrough extending downward therefrom and adjacent the interior edge, the second lid having an upper surface with graduated markings sequential with the graduated markings of the first lid and next to the second rear edge for measuring a fish, the second lid being positionable over the small chamber of the container with each slot aligning with the passage of the second upper edge of the rear wall and the aperture of the interior wall; and a cylindrical rod having a length for positioning through the slots of the lid, the aperture of the projecting upper edge of the interior wall and the passage of the first and second upper edge of the rear wall, the rod capable of securing the first lid and the second lid to the rear wall of the container in a movable manner for opening, the rod capable of securing the first lid and the second lid to the container whereby the front edge, the exterior edge and the interior edge of the first and second lid rest upon the respective front edge and short edge of the container in a closed position, the interior edge of the first and second lid rest flush with the respective shelf of the interior wall.

* * * * *